United States Patent [19]

Saccoccio

[11] 4,188,799

[45] Feb. 19, 1980

[54] EAR CLIP

[75] Inventor: Nazareno J. Saccoccio, East Greenwich, R.I.

[73] Assignee: Aro-Sac Inc., Providence, R.I.

[21] Appl. No.: 905,094

[22] Filed: May 8, 1978

[51] Int. Cl.[2] ..... A44C 7/00

[52] U.S. Cl. ..... 63/14 D; 63/14 E; 24/252 B; 85/36; 24/243 R

[58] Field of Search ..... 63/14 C, 14 D, 14 E; 24/243 R, 252 R, 252 B, 279; 85/36

[56] References Cited

U.S. PATENT DOCUMENTS

| | | | |
|---|---|---|---|
| 2,295,685 | 9/1942 | Place | 24/243 R X |
| 2,415,540 | 2/1947 | Simmons | 85/36 |
| 3,176,475 | 4/1965 | Saccoccio | 63/14 D |
| 3,987,644 | 10/1976 | Saccoccio | 63/14 D |
| 4,078,281 | 3/1978 | Pease et al. | 24/279 |
| 4,083,465 | 4/1978 | Pate et al. | 85/36 X |

*Primary Examiner*—F. Barry Shay

*Attorney, Agent, or Firm*—Salter & Michaelson

[57] ABSTRACT

A clip for an earring or the like comprising separate jaw members pivotally attached for movement towards and away from each other. A first jaw member includes an ornamental portion and is provided with contact means adapted to contact outer portions of the wearer's earlobe. A second jaw is provided with a generally C-shaped loop having base, root and terminal segments. A pair of spaced smooth bore openings are respectively provided through the root and terminal segments for receipt of a screw provided at one end thereof with contact means adapted to cooperate with the contact means of the first jaw member and for engaging the opposite side of the earlobe, and at the other end, with means for manually rotating said screw for movement relative to the first jaw. The terminal segment of the loop is angularly disposed with regard to the screw so that as the screw passes through the opening therein, the front top edge and the bottom rear edges of said opening make threaded engagement with the screw.

8 Claims, 7 Drawing Figures

EAR CLIP

BACKGROUND AND SUMMARY OF THE INVENTION

Earring clips of the spring pressure type having adjustable contact spacing and which utilize a transversely mounted screw member adapted for axial back and forth movement in relationship to the clip portion to which it is mounted, are generally known. Commercial embodiments of such devices are disclosed in U.S. Pat. Nos. 3,176,475 issued Apr. 6, 1965 and 3,987,644 issued Oct. 26, 1976, both to the present inventor. Both such constructions utilize an opening or openings provided in the terminal portion of one of the jaw members such that an adjusting screw may be moved transversely thereof. In the '475 patent, a terminal tooth 34 interengages the threads 28 of the screw 25 while in the '644 patent, an arcuately recessed terminal end portion 48 having a leading edge 49 is adapted to be disposed between the individual threads of the screw 44. The above citation and discussion of these patents constitutes applicant's Prior Art Disclosure and in that regard, a copy of each such patent is enclosed with this application.

Despite the commercial acceptance of the ear clip constructions above discussed, it may be seen that such to some extent require a fixed screw diameter in order to acheive smooth non-binding thread manipulation. Inasmuch as such ear clips are often plated with decorative or functional material coatings, the effective diameter of the screw may be greater than that intended, such that binding or other ineffective operation of the screw results. Generally, the earring clip components are formed from any suitable metallic material and are thereafter further coated, as by electroplating or other known procedures.

Also, since the threaded engagement in both of the aforementioned patents is achieved by contact of a blade-like extension against one side only of the screw, stripping of the screw with respect to its threaded support is too easily achieved.

It is therefore a primary object of this invention to provide an earring pressure clip construction having a threaded adjusting screw wherein the screw is threadably received by a non-threaded bore or opening in such a manner that the screw is threadably engaged by upper and lower edges of said opening at spaced axial points on said screw to effect a relatively secure threaded interengagement.

Another object of the present invention is to provide an earring clip construction which will operate smoothly within an expanded range of screw diameters such as may be caused by coating build-up thereon.

A further object of the present invention is the provision of an earring clip construction of the aforementioned type wherein the bore or opening which threadably receives the screw will automatically self-adjust so as to effectively accommodate slight variations in screw diameter.

These and other objects of the present invention are accomplished by providing a generally C-shaped loop at the terminal portion of one of the jaw members wherein the root portion of said loop is provided with an opening that freely receives the adjusting screw, while the top terminal segment thereof is provided with an aligned angularly inclined opening adapted to threadably engage the screw member at axially spaced locations, such that upward biasing of the terminal segment towards a more normal disposition with regard to the screw member will effectively enlarge the diameter of the opening so as to accommodate variations in screw diameter.

Other objects, features and addvantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
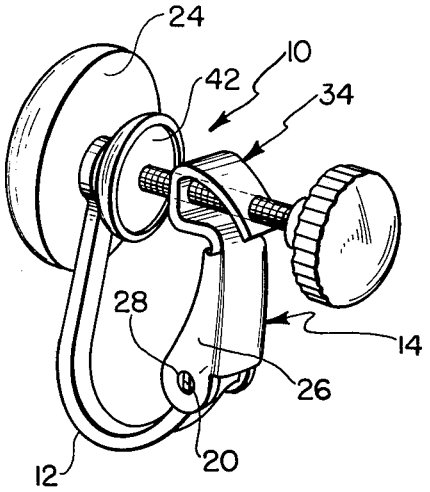
FIG. 1 is a perspective view of an earring clip embodying the present invention.
Figure 2:
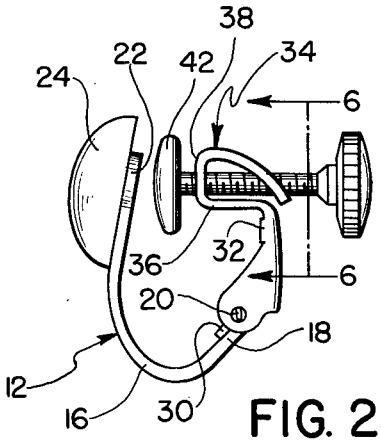
FIG. 2 is a side elevational view thereof.

Referring to the drawing, an earring 10 is shown as comprising a first jaw member 12 and a second jaw member 14. Jaw 12 is of overall J-shaped configuration having a lower curved loop portion 16 adapted to partially encircle a wearer's ear lobe and upwardly extend in a short arm 18 in turn having outwardly extending terminal pintles 20. The other end of the jaw 12 terminates in a generally circular pad or contact member 22 and is provided at an outer portion thereof with an ornament 24. The pad or contact member is, as will hereinafter be more apparent, adapted to contact outer portions of the wearer's earlobe.

Figure 3:
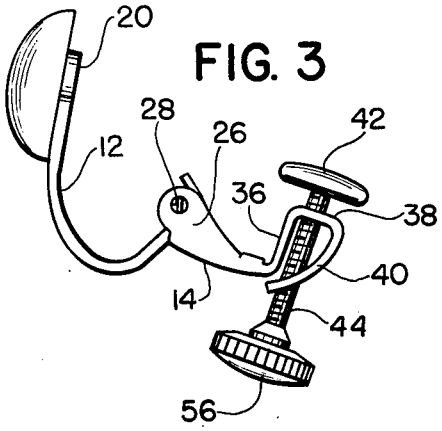
FIG. 3 is a side elevational view similar to FIG. 2 but showing the clip in an open or expanded position.
Figure 4:
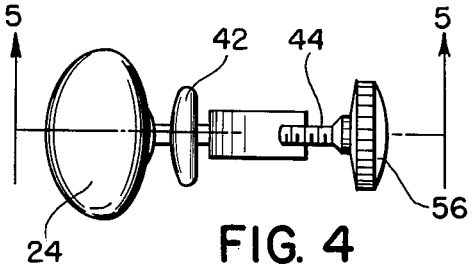
FIG. 4 is a top plan view of the device shown in FIG. 2.
Figure 5:
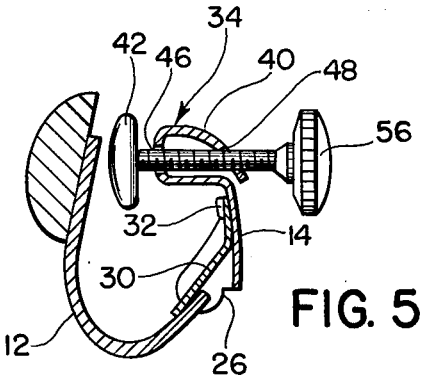
FIG. 5 is a side sectional view taken along the line 5—5 of FIG. 4.
Figure 6:
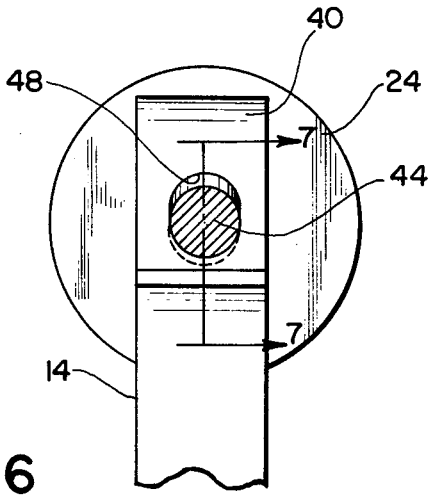
FIG. 6 is an end sectional view taken along the line 6—6 of FIG. 2.

The second jaw member 14 terminates at one end in a pair of parallel spaced ears 26 in turn each having an opening 28 provided therethrough for receipt of the pintles 20. A leaf spring 30 is clamped to the jaw member 14 by bent lugs 32. One end of the spring engages end portions of the terminal arm 18, as best shown in FIG. 5, and is accordingly operable to maintain the jaw members 12 and 14 in a closed position, as depicted in FIG. 5, or in an open position, as best shown in FIG. 3, wherein the spring 30 contacts that portion of the outer edge of the arm 18 disposed between the pintles 20.

Figure 7:
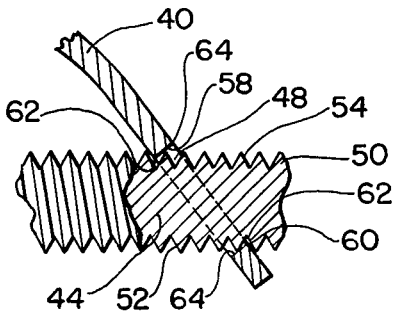
FIG. 7 is a sectional view taken along the line 7—7 of FIG. 6.

The other end of the jaw member 14 terminates in a generally C-shaped loop 34 having base 36, root 38 and terminal 40 segments thereof. The loop may be abruptly bent proximate the lugs 32 so as to form the base segment 36 which is positioned as low as possible so as to minimize the overall height of the second jaw 14. The bend is preferably inward so that the root segment 38 thereof is disposed proximate to a lobe contacting pad 42 of a screw member 44. The screw member 44 is adapted for positioning transversely of the second jaw 14 and passes freely through a smooth bore or opening 46 formed within the root segment 38. A second smooth bore 48 is provided in the terminal top segment 40. This segment 40, as best shown in FIG. 7, passes across the screw in a generally angular disposition. The screw member 44 is provided with a plurality of standard threads 50 having lead surfaces 52 and trailing surfaces 54 respectively. The other end of the screw member 44 is provided with a knurled head 56 so as to better enable the screw to be turned so as to effect axial movement back and forth with respect to the second jaw member 14 so that the spacing between contacts 22 and 42 may be adjusted to accordingly vary the amount of pressure applied to the wearer's ear.

The opening 48 includes an unthreaded inner peripheral face 58 disposed normally to adjacent surface portions 60 of the terminal top segment 40. The surfaces 58 and 60 thus meet to form radially inner edges 62 and radially outer edges 64 relative to the axis of opening 48. Because of the angular disposition of the terminal segment 40 with regard to the screw, the vertical distance between the inner edges 62 is less than that between the outer edges 64. Also as may be best seen by reference to FIG. 7, the vertical distance between edges 62 is somewhat greater than the root diameter of the screw 44 and the vertical distance between the edges 64 is somewhat less than the overall thread to thread diameter of the screw 44. Accordingly, when the screw member 44 is rotated, the scsrew threads 50 will contact the inner edges 62 of the opening 48 at spaced axially locations along the screw 44 so as to move such transversely back and forth with respect to the jaw member 14. Thus, while the screw 44 passes freely through the opening 46 in the manner of a guide, the screw is engaged by the opening 48 at two axially spaced locations so as to securely grasp the screw. The likelihood of the screw stripping past the single contact areas as in prior art devices is accordingly effectively reduced in the manner intended by this invention and without resorting to more expensive threaded bore constructions. The construction also affords smooth yet positive movement of the adjusting screw 44. In the event that variations in diameter of the screw member 44 occur, movement of the screw member 44 relative to the top segment 40 will serve to arcuately pivot, bend or flex the terminal portion into an increased angular relationship, i.e. towards an angular relationship approaching a normal disposition of the top segment 40 with respect to the screw member 44. Such upward flexure of the terminal segment 40, increases the effective vertical spacing between inner edges 62 so as to readily accommodate increased thicknesses in the diameter of the screw member 44 such as may be caused by buildup of plated or otherwise coated layers thereon.

Generally the terminal segment is bent to the particular angular relationship with the screw 44 desired dependent on the thickness of the screw and thus can accommodate screws of either oversize or undersize diameter. Also, while the bent segment 40 inherently may have some resilience or spring, the terminl segment may be formed from spring material to effect a more pronounced upward movement against the screw (counterclockwise as viewed in FIG. 7) so as to force the inner edges 62 into spring urged contact with the threads 50. This spring action may be overcome by relative transverse movement of the screw so as to upwardly urge the terminal segment 40 in a clockwise direction to enlarge the effective vertical space of opening 48 so as to accommodate larger overall thicknesses of the screw 44.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the apended claims.

What is claimed is:

1. A clip for earrings and the like comprising first and second jaw members pivotally connected to each other at respective ends thereof, said members movable between open and closed positions thereof and including spring means for urging said members to said closed position, said first jaw members having means at the other end thereof for contacting outer lobe portions of a wearer's ear, said second jaw member terminating at its other end in a generally C-shaped loop having in sequence, base, root and terminal segments, a pair of spaced aligned smooth bore openings respectively provided through said root and said terminal segments a screw carried by said loop received through said aligned openings, said screw provided at one end thereof with contact means adapted to cooperate with said contact means on said first jaw member and for engaging the opposite side of said ear lobe and at the other end thereof with means for manually rotating said screw for movement relative to said first jaw member for adjusting the spacing between both of said contact means and accordingly the amount of pressure exerted by said clip upon the ear, the terminal segment of said loop passing across and beneath said screw in a non-perpendicular angular position relative to the axis of said screw such that the screw receiving opening therein is similarly inclined with respect to said screw so that edge portions of said terminal segment defining said opening contact thread surfaces of said screw at axially spaced positions along said screw, whereby said screw is firmly threadably engaged by said terminal segment, said terminal segment being deflectable in the direction toward said root segment towards a more normal disposition with said screw axis by advancing movement of said screw wherein the effective diameter of said terminal segment opening is increased so as to accomodate increased screw thicknesses without binding.

2. The clip construction of claim 1, said opening in said terminal segment being defined by an inner peripheral face disposed normally to outer adjacent surface portions of said terminal segment, said opening by reason of its angular disposition thus defining inner and outer edges, said inner edges defining a vertical orientated space for receipt of said screw member which is greater than the root diameter but smaller than the overall diameter of said screw.

3. The clip construction of claim 1, said top segment edge portions separately contacting said screw at loctions above and below said screw.

4. The clip construction of claim 1, said opening through said base segment freely receiving said screw in non-threaded guiding relationship.

5. The clip construction of claim 1, said root segment of said C-shaped loop disposed proximate to said screw member.

6. The clip construction of claim 4, said second jaw being abruptly inwardly bent towards said screw member contact means to form said base segment of said loop, said base segment extending along said screw member and closely adjacent thereto.

7. The clip construction of claim 1, said spring means comprising a flat leaf spring connected to said second jaw member and bearing at one end thereof against said first jaw member.

8. The clip construction of claim 1, said loop terminal segment being slightly arcuately movable about its connection with said root portion and towards the base portion thereof.

* * * * *